US008434357B2

(12) United States Patent
Hsu et al.

(10) Patent No.: US 8,434,357 B2
(45) Date of Patent: May 7, 2013

(54) CLEAN FLUID SAMPLE FOR DOWNHOLE MEASUREMENTS

(75) Inventors: Kai Hsu, Sugar Land, TX (US); Kentaro Indo, Edmonton (CA); Sihar Marpaung, Sagamihara (JP); Kazumasa Kanayama, Tokyo (JP); Peter S. Hegeman, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 644 days.

(21) Appl. No.: 12/543,042

(22) Filed: Aug. 18, 2009

(65) Prior Publication Data

US 2011/0042071 A1 Feb. 24, 2011

(51) Int. Cl.
*E21B 49/10* (2006.01)

(52) U.S. Cl.
USPC ..... 73/152.24

(58) Field of Classification Search ... 73/152.23–152.36
See application file for complete search history.

(56) References Cited

U.S. PATENT DOCUMENTS

| | | | | |
|---|---|---|---|---|
| 4,860,581 | A * | 8/1989 | Zimmerman et al. | 73/152.26 |
| 5,741,962 | A * | 4/1998 | Birchak et al. | 73/152.16 |
| 6,334,489 | B1 | 1/2002 | Shwe | |
| 7,036,579 | B2 * | 5/2006 | Follini et al. | 166/100 |
| 7,178,591 | B2 * | 2/2007 | Del Campo et al. | 166/264 |
| 7,346,460 | B2 | 3/2008 | DiFoggio et al. | |
| 7,347,262 | B2 * | 3/2008 | Tarvin et al. | 166/264 |
| 7,458,252 | B2 | 12/2008 | Freemark et al. | |
| 7,461,547 | B2 | 12/2008 | Terabayashi et al. | |
| 7,484,563 | B2 * | 2/2009 | Zazovsky et al. | 166/264 |
| 7,913,556 | B2 * | 3/2011 | Hsu et al. | 73/152.28 |
| 8,047,286 | B2 * | 11/2011 | Zazovsky et al. | 166/264 |
| 8,109,155 | B2 * | 2/2012 | Otsuka | 73/861.95 |
| 8,146,655 | B2 * | 4/2012 | Indo et al. | 166/250.01 |
| 8,156,800 | B2 * | 4/2012 | Terabayashi et al. | 73/152.27 |
| 2008/0156088 | A1 | 7/2008 | Hsu et al. | |
| 2008/0156487 | A1 * | 7/2008 | Zazovsky et al. | 166/264 |
| 2009/0308600 | A1 * | 12/2009 | Hsu et al. | 166/250.01 |
| 2010/0212889 | A1 * | 8/2010 | Otsuka | 166/250.01 |
| 2011/0042070 | A1 * | 2/2011 | Hsu et al. | 166/250.01 |

OTHER PUBLICATIONS

Lee, J. et al., Using PV Tests for Bubble Point Pressures and Quality Control, SPWLA 44th Annual Logging Symposium, Jun. 22-25, 2003, pp. 1-7.

* cited by examiner

*Primary Examiner* — John Fitzgerald
(74) *Attorney, Agent, or Firm* — John Vereb

(57) ABSTRACT

A system and method for obtaining a clean fluid sample for analysis in a downhole tool are provided. In one example, the method includes directing fluid from a main flowline of the downhole tool to a secondary flowline of the downhole tool. While the fluid is being directed into the secondary flowline, sensor responses corresponding to the fluid in the secondary flowline are monitored to determine when the sensor responses stabilize. The secondary flowline is isolated from the main flowline after the sensor responses have stabilized. A quality control procedure is performed on the fluid in the secondary flowline to determine whether the captured fluid is the same as the fluid in the main flowline. Additional fluid from the main flowline is allowed into the secondary flowline if the captured fluid is not the same.

22 Claims, 9 Drawing Sheets

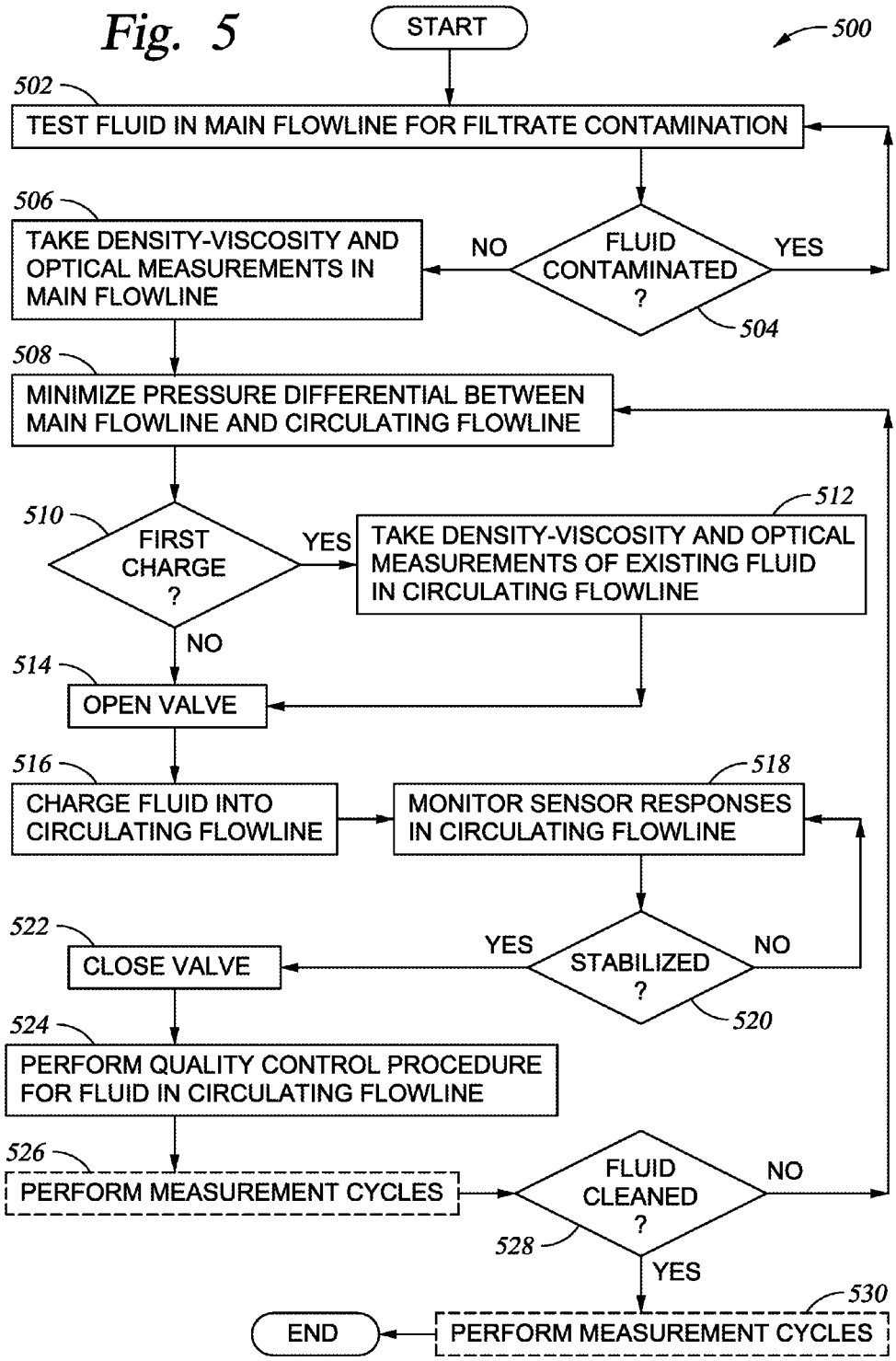
Fig. 5
START
500
502
TEST FLUID IN MAIN FLOWLINE FOR FILTRATE CONTAMINATION
506
TAKE DENSITY-VISCOSITY AND OPTICAL MEASUREMENTS IN MAIN FLOWLINE
NO
FLUID CONTAMINATED ?
YES
504
508
MINIMIZE PRESSURE DIFFERENTIAL BETWEEN MAIN FLOWLINE AND CIRCULATING FLOWLINE
510
FIRST CHARGE ?
YES
512
TAKE DENSITY-VISCOSITY AND OPTICAL MEASUREMENTS OF EXISTING FLUID IN CIRCULATING FLOWLINE
NO
514
OPEN VALVE
516
CHARGE FLUID INTO CIRCULATING FLOWLINE
518
MONITOR SENSOR RESPONSES IN CIRCULATING FLOWLINE
522
CLOSE VALVE
YES
STABILIZED ?
NO
520
524
PERFORM QUALITY CONTROL PROCEDURE FOR FLUID IN CIRCULATING FLOWLINE
526
PERFORM MEASUREMENT CYCLES
FLUID CLEANED ?
NO
528
YES
530
END
PERFORM MEASUREMENT CYCLES

CLEAN FLUID SAMPLE FOR DOWNHOLE MEASUREMENTS

CROSS-REFERENCE TO RELATED APPLICATIONS

This application is related to and incorporates herein by reference in their entirety the following patent applications and patents: U.S. patent application Ser. No. 12/543,017, filed on Aug. 18, 2009 and entitled "Fluid Density from Downhole Optical Measurements"; U.S. patent application Ser. No. 12/137,058, filed Jun. 11, 2008, and entitled "Methods and Apparatus to Determine the Compressibility of a Fluid"; and U.S. Pat. Nos. 6,474,152; 7,461,547; and 7,458,252.

BACKGROUND

Reservoir fluid analysis is a key factor for understanding and optimizing reservoir management. In most hydrocarbon reservoirs, fluid composition varies vertically and laterally in a formation. Fluids characteristics, including density and compressibility, may exhibit gradual changes caused by gravity or biodegradation, or they may exhibit more abrupt changes due to structural or stratigraphic compartmentalization. Traditionally, fluid information is obtained by capturing samples, either at downhole or surface conditions, and then measuring various properties of the samples in a surface laboratory. In recent years, downhole fluid analysis (DFA) techniques, such as those using a Modular Formation Dynamics Tester (MDT) tool, have been used to provide downhole fluid property information.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 5 is a flow chart diagram of at least a portion of a method according to one or more aspects of the present disclosure.

DETAILED DESCRIPTION

Figure 1:
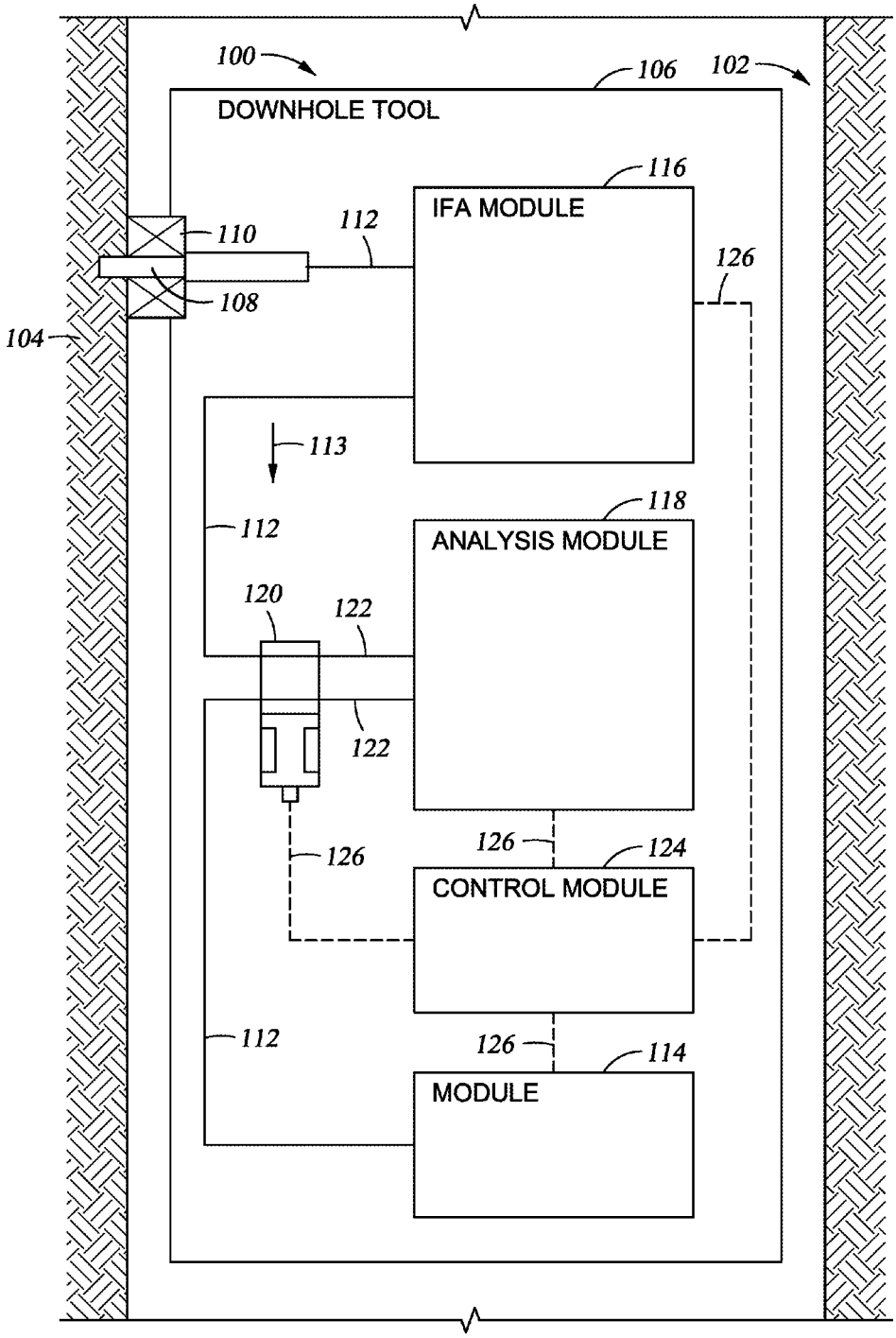
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure describes embodiments illustrating the capture of clean reservoir fluid in a circulation flow loop of a downhole tool for subsequent analysis. It is noted that the term "clean reservoir fluid" as used herein means that the captured fluid is identical or substantially similar (e.g., similar within a defined range of attributes) to fluid flowing in a main flowline of the downhole tool. Accordingly, the clean reservoir fluid may not necessarily be contamination-free (i.e., free of contamination from the mud and/or mud filtrate used to drill the borehole), but is the same as fluid flowing in the main flowline. In some embodiments, the clean reservoir fluid may be used to completely displace any pre-existing fluid in the circulating flow loop.

FIG. 1 is a schematic view of a downhole tool 100 according to one or more aspects of the present disclosure. The tool 100 may be used in a borehole 102 formed in a geological formation 104, and may be conveyed by wire-line, drill-pipe, tubing, and/or any other means (not shown) used in the industry. The tool 100 comprises a housing 106 that contains a sampling probe 108 with a seal (e.g., packer) 110 that is used to acquire a fluid sample, such as hydrocarbon, from the formation 104.

The fluid sample enters a main flowline 112 that may be used to transport the sample to other locations within the tool 100, including a module 114, an In-situ Fluid Analyzer (IFA) module 116, and an analysis module 118. Within the tool 100, the fluid moves in a direction indicated by arrow 113. The modules may represent many different types of components/systems and may perform many different functions. For example, one or more of the modules may contain pressure and temperature sensors, while other modules may be or comprise a pump used to move the sample through the flowline 112. The IFA module 116 may include components configured to ensure that clean reservoir fluid is captured from the main flowline 112 for use by the analysis module 118. The analysis module 118 may include components configured to perform optical analysis of the sample to measure fluid density and compressibility, among other characteristics. One or more valves 120 may be used to control the delivery of the fluid sample from the flowline 112 to the analysis module 118 via one or more circulating flowlines 122. A control module 124 may be in signal communication with the IFA module 116, the analysis module 118, valve 120, and/or other modules via communication channels 126.

Figure 2A:
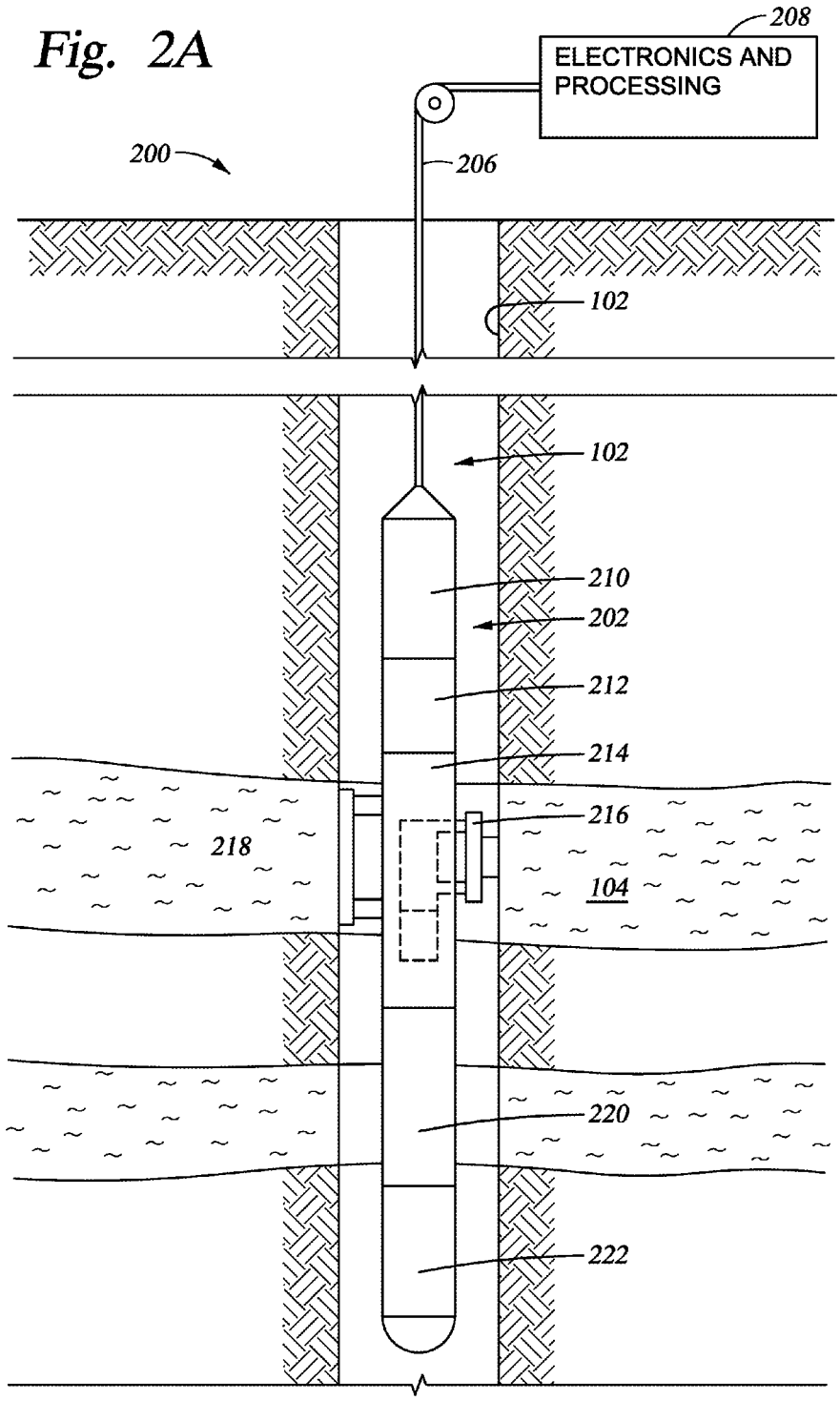
FIG. 2A is a schematic view of apparatus according to one or more aspects of the present disclosure.

FIG. 2A is a schematic view of apparatus according to one or more aspects of the present disclosure, including one embodiment of an environment 200 with a wireline tool 202 in which aspects of the present disclosure may be implemented. The wireline tool 202 may be similar or identical to the downhole tool 100 of FIG. 1. The wireline tool 202 is suspended in a wellbore 102 from the lower end of a multi-conductor cable 206 that is spooled on a winch (not shown) at the Earth's surface. At the surface, the cable 206 is communicatively coupled to an electronics and processing system 208. The wireline tool 202 includes an elongated body 210 that includes a formation tester 214 having a selectively extendable probe assembly 216 and a selectively extendable tool anchoring member 218 that are arranged on opposite sides of the elongated body 210. Additional modules 212 (e.g., components described above with respect to FIG. 1) may also be included in the tool 202.

One or more aspects of the probe assembly 216 may be substantially similar to those described above in reference to the embodiments shown in FIG. 1. For example, the extendable probe assembly 216 is configured to selectively seal off or isolate selected portions of the wall of the wellbore 102 to fluidly couple to the adjacent formation 104 and/or to draw fluid samples from the formation 104. The formation fluid may be analyzed and/or expelled into the wellbore through a port (not shown) as described herein and/or it may be sent to one or more fluid collecting chambers 220 and 222. In the illustrated example, the electronics and processing system 208 and/or a downhole control system (e.g., the control module 124 of FIG. 1) are configured to control the extendable probe assembly 216 and/or the drawing of a fluid sample from the formation 104.

Figure 2B:
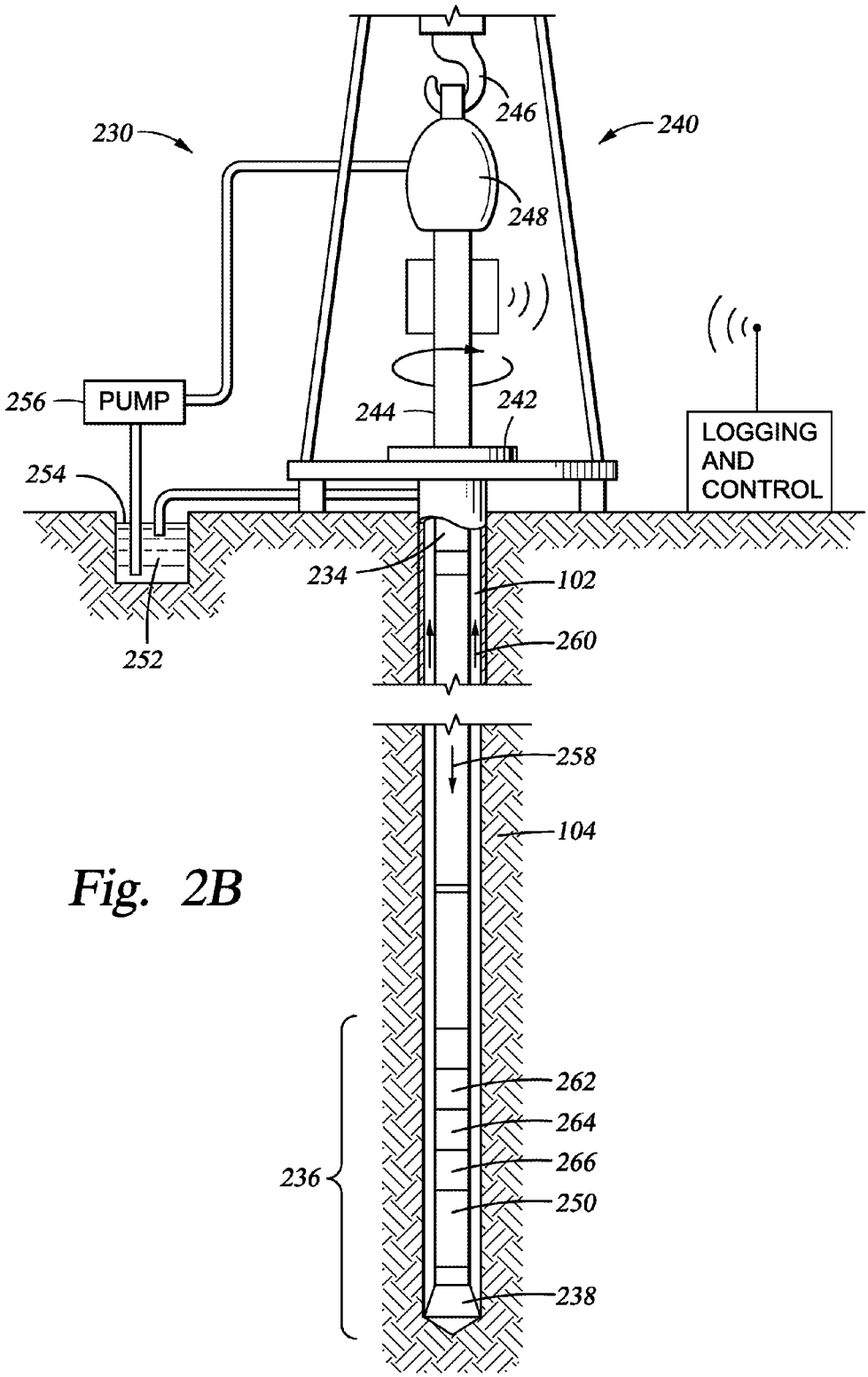
FIG. 2B is a schematic view of apparatus according to one or more aspects of the present disclosure.

FIG. 2B is a schematic view of apparatus according to one or more aspects of the present disclosure, including one embodiment of a wellsite system environment 230 in which aspects of the present disclosure may be implemented. The wellsite can be onshore or offshore. A borehole 102 is formed in subsurface formations (e.g., the formation 104 of FIG. 1) by rotary drilling and/or directional drilling.

A drill string 234 is suspended within the borehole 102 and has a bottom hole assembly 236 that includes a drill bit 238 at its lower end. The surface system includes platform and derrick assembly 240 positioned over the borehole 102, the assembly 240 including a rotary table 242, kelly 244, hook 246 and rotary swivel 248. The drill string 234 is rotated by the rotary table 242, energized by means not shown, which engages the kelly 244 at the upper end of the drill string. The drill string 234 is suspended from the hook 246, attached to a traveling block (also not shown), through the kelly 244 and the rotary swivel 248, which permits rotation of the drill string relative to the hook. As is well known, a top drive system could alternatively be used.

The surface system further includes drilling fluid or mud 252 stored in a pit 254 formed at the well site. A pump 256 delivers the drilling fluid 252 to the interior of the drill string 234 via a port in the swivel 248, causing the drilling fluid to flow downwardly through the drill string 234 as indicated by the directional arrow 258. The drilling fluid 252 exits the drill string 234 via ports in the drill bit 238, and then circulates upwardly through the annulus region between the outside of the drill string and the wall of the borehole 102, as indicated by the directional arrows 260. In this well known manner, the drilling fluid 252 lubricates the drill bit 238 and carries formation cuttings up to the surface as it is returned to the pit 254 for recirculation.

The bottom hole assembly 236 may include a logging-while-drilling (LWD) module 262, a measuring-while-drilling (MWD) module 264, a roto-steerable system and motor 250, and drill bit 238. The LWD module 262 may be housed in a special type of drill collar, as is known in the art, and can contain one or more known types of logging tools. It is also understood that more than one LWD and/or MWD module can be employed, e.g., as represented by LWD tool suite 266. (References, throughout, to a module at the position of 262 can alternatively mean a module at the position of 266 as well.) The LWD module 262 (which may be similar or identical to the tool 100 shown in FIG. 1 or may contain components of the tool 100) may include capabilities for measuring, processing, and storing information, as well as for communicating with the surface equipment. In the present embodiment, the LWD module 262 includes a fluid analysis device, such as that described with respect to FIG. 1.

The MWD module 264 may also be housed in a special type of drill collar, as is known in the art, and can contain one or more devices for measuring characteristics of the drill string 234 and drill bit 238. The MWD module 264 further includes an apparatus (not shown) for generating electrical power to the downhole system. This may typically include a mud turbine generator powered by the flow of the drilling fluid, it being understood that other power and/or battery systems may be employed. The MWD module 264 may include one or more of the following types of measuring devices: a weight-on-bit measuring device, a torque measuring device, a vibration measuring device, a shock measuring device, a stick/slip measuring device, a direction measuring device, and an inclination measuring device.

Figure 2C:
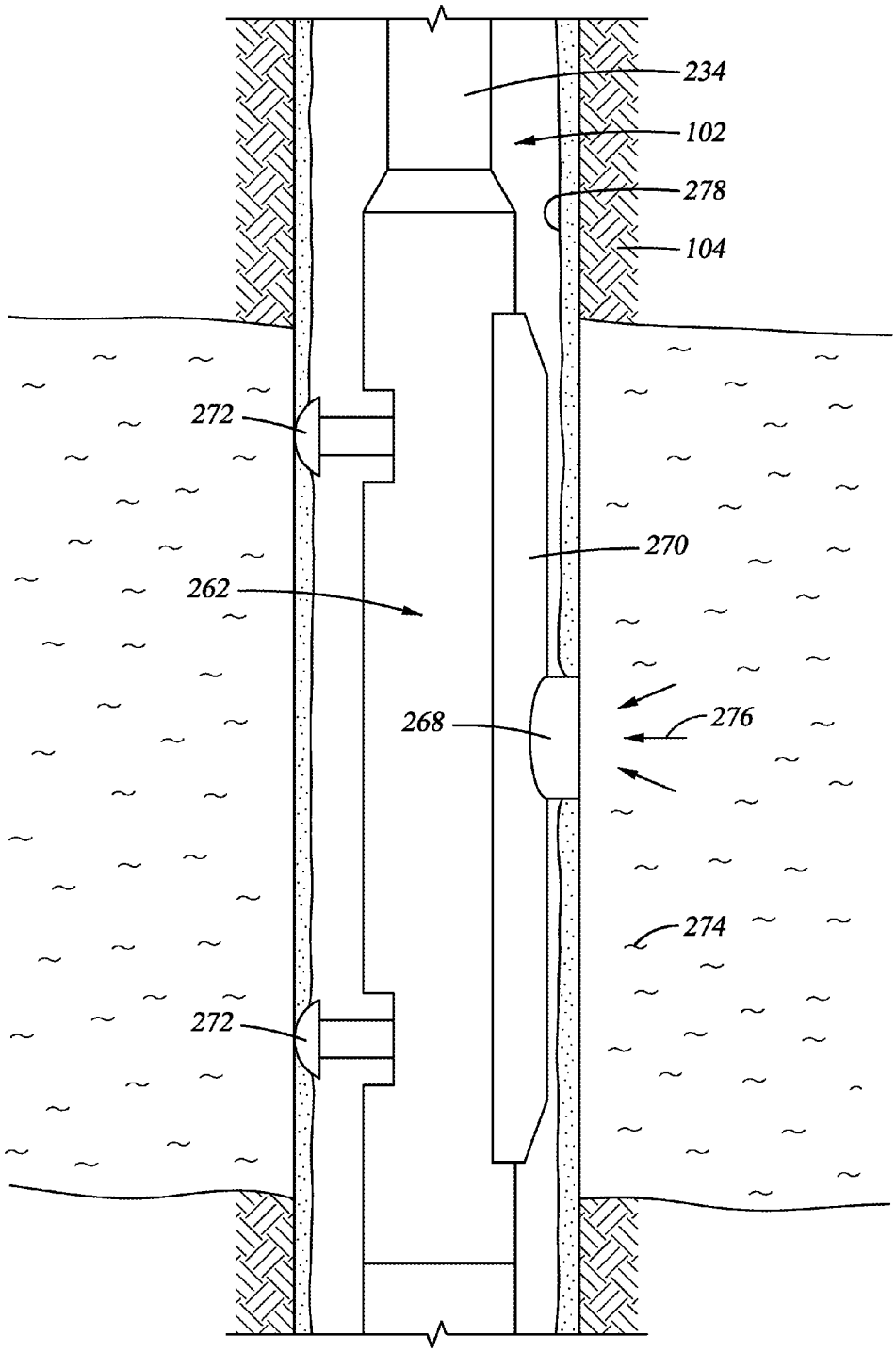
FIG. 2C is a schematic view of apparatus according to one or more aspects of the present disclosure.

FIG. 2C is a simplified diagram of a sampling-while-drilling logging device of a type described in U.S. Pat. No. 7,114,562 (incorporated herein by reference in its entirety) utilized as the LWD module 262 or part of the LWD tool suite 266. The LWD module 262 is provided with a probe 268 (which may be similar or identical to the probe 108 of FIG. 1) for establishing fluid communication with the formation 104 and drawing fluid 274 into the module, as indicated by the arrows 276. The probe 268 may be positioned in a stabilizer blade 270 of the LWD module 262 and extended therefrom to engage a wall 278 of the borehole 102. The stabilizer blade 270 may include one or more blades that are in contact with the borehole wall 278. Fluid 274 drawn into the LWD module 262 using the probe 268 may be measured to determine, for example, pretest and/or pressure parameters. The LWD module 262 may also be used to obtain and/or measure various characteristics of the fluid 274. Additionally, the LWD module 262 may be provided with devices, such as sample chambers, for collecting fluid samples for retrieval at the surface. Backup pistons 272 may also be provided to assist in applying force to push the LWD module 262 and/or probe 268 against the borehole wall 278.

Figure 3A:
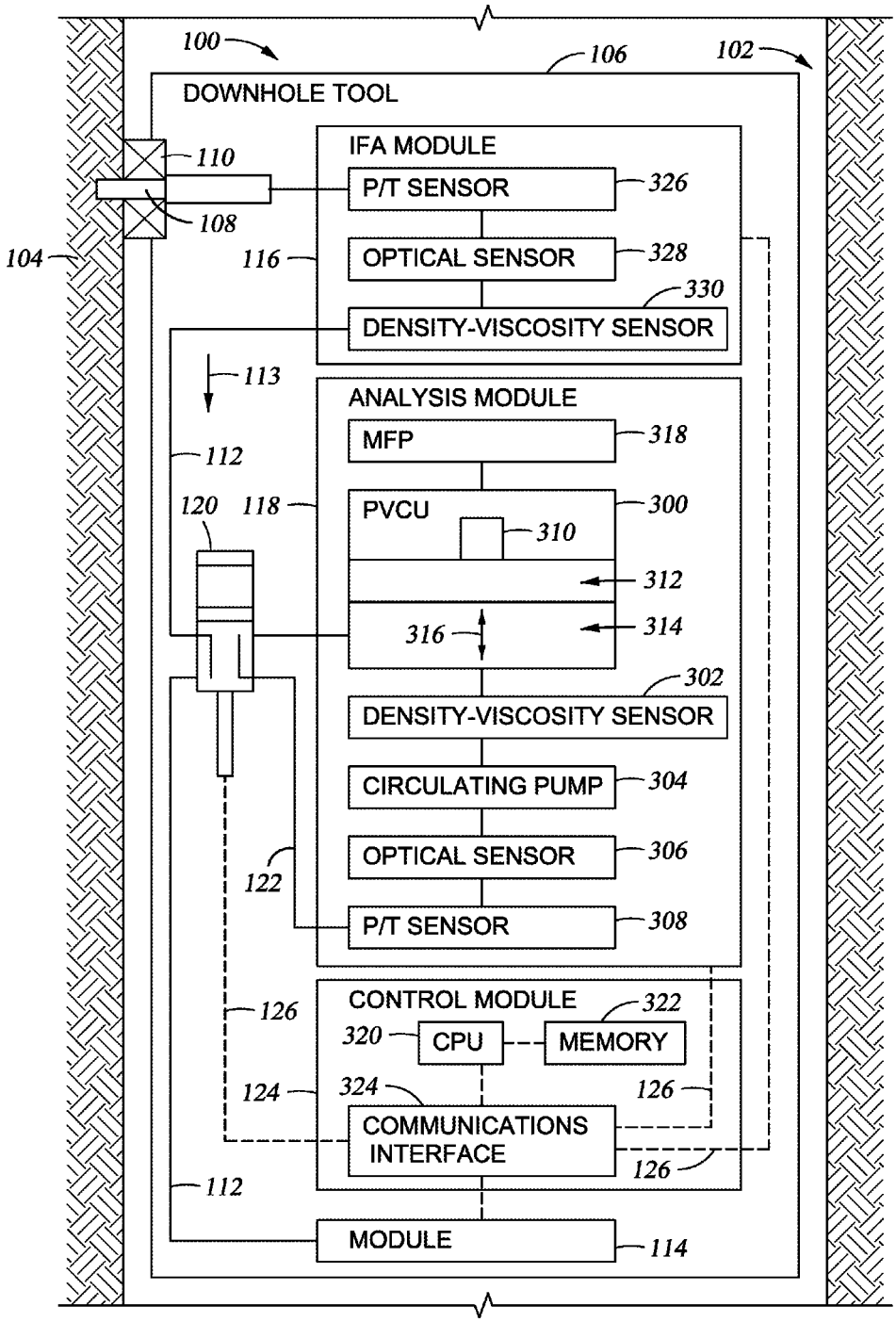
FIG. 3A is a schematic view of apparatus according to one or more aspects of the present disclosure.
Figure 3B:
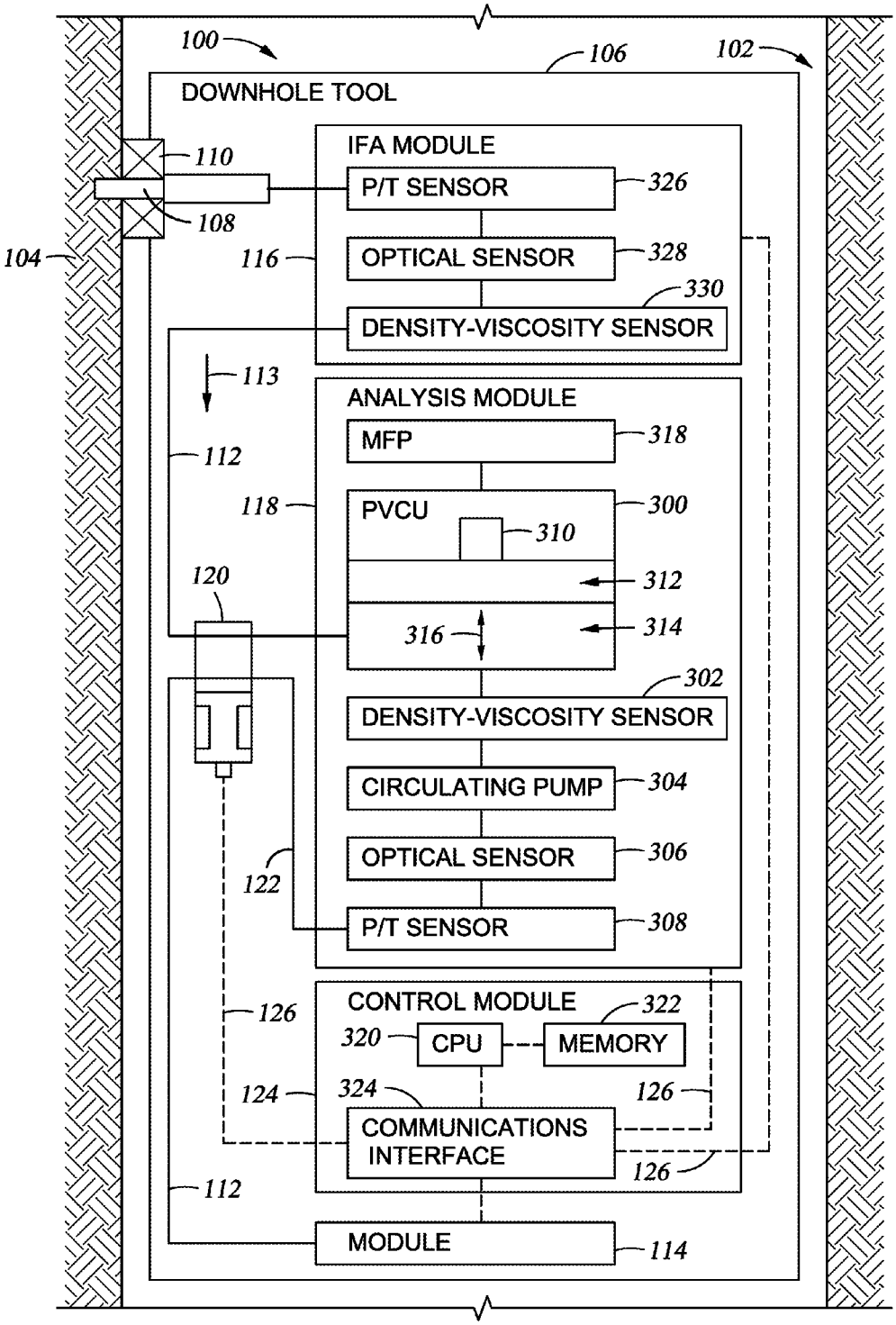
FIG. 3B is a schematic view of apparatus according to one or more aspects of the present disclosure.

FIGS. 3A and 3B are schematic views of an embodiment of the downhole tool 100 of FIG. 1 according to one or more aspects of the present disclosure. The valve 120, which may be a 4-by-2 valve (e.g., a four-port, two-position valve), is configured to control flow of the fluid sample from the main flowline 112 into the circulating flowline 122. By separating the analysis module 118 from the main flowline 112, various pressurization functions and/or other processes may be performed in an isolated manner. FIG. 3A shows the analysis module 118 isolated from the main flowline 112 and FIG. 3B shows the analysis module coupled to the main flowline 112.

The analysis module 118 may include a pressure volume control unit (PVCU) 300, a density-viscosity sensor 302, a circulating pump 304, an optical sensor 306, and/or a pressure/temperature (P/T) sensor 308. Each component 300, 302, 304, 306, and 308 may be in fluid communication with the next component via the circulating flowline 122. It is understood that the components 300, 302, 304, 306, and 308, circulating flowlines 122, and/or valves 120 may be arranged differently in other embodiments, and additional flowlines and/or sensors and/or valves may be present. The circulating flowline 122 may form a circulation flow loop.

The PVCU 300 may include a piston 312 having a shaft 310. The piston 312 may be positioned in a chamber 314 within which the body may move along a line indicated by arrow 316. A motive force producer (MFP) 318 (e.g., a motor) may be used to control movement of the piston 312 within the chamber 314 via the shaft 310. As the piston 312 moves back and forth along line 316, fluid in the circulation flow loop provided by the flowline 122 may be pressurized and depressurized. The PVCU 300 may be offset (e.g., not in the direct flow path of the circulation flow loop) yet remain in fluid communication with the circulation flow loop.

The density-viscosity sensor 302 is one example of a variety of density-viscosity sensors that may be used in the analysis module 118. As is known, a density-viscosity sensor (i.e., a densitometer) may be used for measuring the fluid density of a downhole fluid sample. Such density-viscosity sensors are generally based on the principle of mechanically vibrating and resonating elements interacting with the fluid sample. Some density-viscosity sensor types use a resonating rod in contact with the fluid to probe the density of the surrounding fluid (e.g., a DV-rod type sensor), whereas other types use a sample flow tube filled with fluid to determine the density of the fluid. The density-viscosity sensor 302 may be used along the circulation flow loop formed by the flowline 122 for measuring the density of the fluid sample.

The circulating pump 304 may be used to agitate fluid within the circulation flow loop provided by the flowline 122. Such agitation may assist in obtaining accurate measurements as described below and/or in co-pending U.S. patent application Ser. No. 12/543,071.

The optical sensor 306 may be a single channel optical spectrometer that is used to detect the fluid phase change during depressurization. However, it is understood that many different types of optical sensors may be used.

The optical sensor 306 may select or be assigned one or more wavelength channels. A particular wavelength channel may be selected to improve sensitivity between the fluid density and corresponding optical measurements as the pressure changes. For example, a wavelength channel of 1600 nanometers (nm) may be used in applications dealing with medium and heavier oil. However, for gas condensate and light oil, there will typically be little optical absorption at this wavelength channel and, as a result, the sensitivity of optical density to fluid density change would be significantly reduced. Accordingly, for gas condensate and light oil, different wavelength channels that show evidence of prominent absorption with hydrocarbon may be employed so that the sensitivity of optical density to fluid density change improves. For example, channel wavelengths of 1671 nm and 1725 nm may be used. Furthermore, the electronic absorption in the ultraviolet (UV)/visible/near infrared (NIR) wavelength region also shows sensitivity with the density (or concentration) of fluid. Therefore, color channels utilized by Live Fluid Analyzer (LFA) or InSitu Fluid Analyzer (IFA) technologies may be used with wavelength channels of 815 nm, 1070 nm, and 1290 nm, for example. By choosing multiple wavelength channels, the signal-to-noise ratio may be improved by jointly inverting the fluid density and compressibility using multi-channel data.

The P/T sensor 308 may be any integrated sensor or separate sensors that provide pressure and temperature sensing capabilities. The P/T sensor 308 may be a silicon-on-insulator (SOI) sensor package that provides both pressure and temperature sensing functions.

The control module 124 may be configured for bidirectional communication with various modules and module components, depending on the particular configuration of the tool 100. For example, the control module 124 may communicate with modules which may in turn control their own components, or the control module 124 may control some or all of the components directly. The control module 124 may communicate with the valve 120, IFA module 116, analysis module 118, and/or module 114. The control module 124 may be specialized and integrated with the analysis module 118 and/or other modules and/or components.

The control module 124 may include a central processing unit (CPU) and/or other processor 320 coupled to a memory 322 in which are stored instructions for the acquisition and/or storage of the measurements, as well as instructions for other functions such as valve and piston control. Instructions for performing calculations based on the measurements may also be stored in the memory 322 for execution by the CPU 320. The CPU 320 may also be coupled to a communications interface 324 for wired and/or wireless communications via communication paths 126. It is understood that the CPU 320, memory 322, and communications interface 324 may be combined into a single device or may be distributed in many different ways. For example, the CPU 320, memory 322, and communications interface 324 may be separate components placed in a housing forming the control module 124, may be separate components that are distributed throughout the tool 100 and/or on the surface, or may be contained in an integrated package such as an application specific integrated circuit (ASIC). Means for powering the tool 100, transferring information to the surface, and/or performing other functions unrelated to the analysis module 118 and/or IFA module 116 may also be incorporated in the control module 124.

Example in-situ calibration and measurement operations of the analysis module 118 are detailed in co-pending United States patent application Ser No. 12/543,017. Measurements that may be acquired during a constant composition expansion process performed by the analysis module 118 may include pressure and temperature versus time from the P/T sensor 308, viscosity and density versus time from the density-viscosity sensor 302, optical sensor response versus time from the optical sensor 306, and/or depressurization rate and volume versus time. Answer products that may be calculated from the preceding measurements may include density versus pressure, viscosity versus pressure, compressibility versus pressure, and/or phase-change pressure (depending on the fluid, this may include one or more of asphaltene onset pressure, bubble point pressure, and dew point pressure).

Before the in-situ calibration and measurement operations of the analysis module 118 are performed, the IFA module 116 may be used to ensure that clean reservoir fluid is available in the circulation flow loop for use by the analysis module 118. The IFA module 116 may comprise a pressure/temperature (P/T) sensor 326, a spectrometer 328, and a density-viscosity sensor 330. The P/T sensor 326 and density-viscosity sensor 330 may be similar or identical to the P/T sensor 308 and density-viscosity sensor 302 of the analysis module 118. The spectrometer 328 may be or comprise a multi-wavelength optical spectrometer and/or other optical measurement device configured to perform the needed measurements on fluid in the main flowline 112.

In operation, fluid in the main flowline 112 passes through the IFA module 116 and into the valve 120, and then either continues through the valve 120 in the main flowline 112 (FIG. 3A) or is directed by the valve 120 into the analysis module 118 (FIG. 3B). It is noted that fluid is captured in the circulating flowline 122 in the configuration of FIG. 3A because the circulating flowline 122 is isolated from the main flowline 112.

It is understood that many different agitation mechanisms (i.e., various forms of agitation and structures for accomplishing such agitation) may be used in place of or in addition to the agitation mechanism provided by the circulation of the fluid sample in the circulation flow loop. For example, some embodiments of an agitation mechanism may use a chamber (i.e., a pressure/volume/temperature cell) having a mixer/agitator disposed therein with the sensor 302 and/or sensor 306. In such an embodiment, the fluid sample may be agitated within the chamber rather than circulated through a circulation flow loop. In other embodiments, such a chamber may be integrated with a circulation flow loop. Accordingly, the terms "agitation" and "agitate" as used herein may refer to any process by which the fluid sample is circulated, mixed, or otherwise forced into motion. Furthermore, as structures other than a fluid flowline may be used, the term "secondary flowline" may be used herein to refer to any structure (e.g., a flowline, chamber, or combination thereof) in which the agitation may occur.

Figure 4:
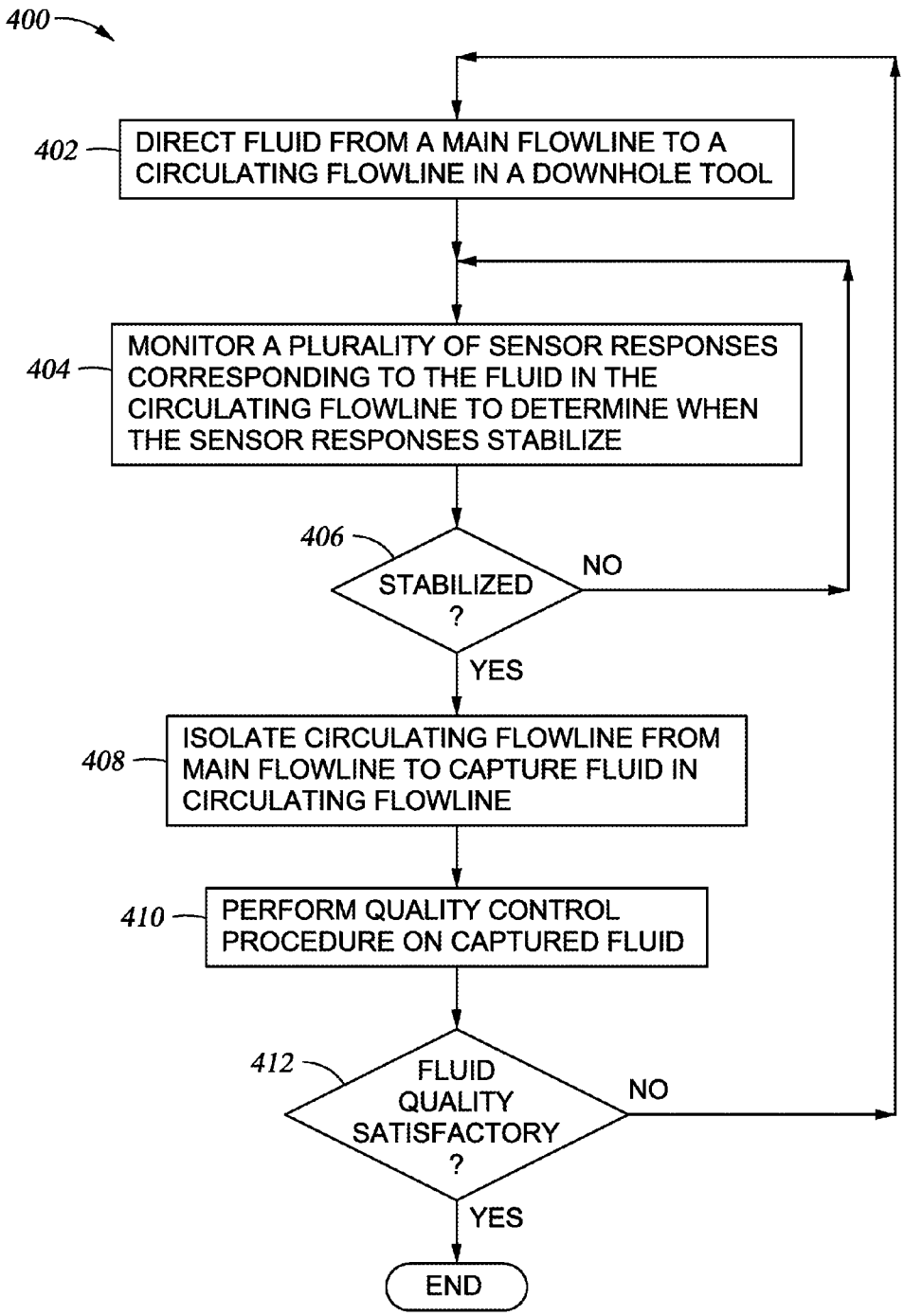
FIG. 4 is a flow chart diagram of at least a portion of a method according to one or more aspects of the present disclosure.

FIG. 4 is a flow-chart diagram of at least a portion of a method 400 according to one or more aspects of the present disclosure. The method 400 may be or comprise a process for ensuring that clean reservoir fluid is available in the circulation flow loop provided by circulating flowline 122.

Referring to FIGS. 3A, 3B and 4, collectively, fluid is directed from the main flowline 112 into the circulating flowline 122 via valve 120 in step 402. In step 404, sensor responses of the optical sensor 306 and/or density-viscosity sensor 302 corresponding to the fluid in the circulating flowline 122 are monitored to determine when the sensor responses stabilize. This monitoring step 404 occurs while the fluid is being directed into the circulating flowline 122. In a decisional step 406, a determination is made as to whether the sensor responses have stabilized. If the sensor responses have not stabilized, the method 400 returns to step 404 and continues the monitoring. Alternatively, if the sensor responses have stabilized, the method 400 continues to step 408, where the circulating flowline 122 is isolated from the main flowline 112 by the valve 120. This isolating step captures fluid in the circulating flowline 122. In step 410, a quality control procedure (described below) is performed on the captured fluid in the circulating flowline 122 to determine whether the captured fluid is the same as the fluid in the main flowline 112. In a decisional step 412, if the captured fluid in the circulating flowline 122 is not the same as the fluid in the main flowline 112 (i.e., the fluid quality is not satisfactory), the method 400 returns to step 402. Alternatively, if the fluids are the same, the method 400 ends.

FIG. 5 is a flow-chart diagram of at least a portion of a method 500 according to one or more aspects of the present disclosure. The method 500 may be or comprise a process for ensuring that clean reservoir fluid is available in the circulation flow loop provided by circulating flowline 122.

Referring to FIGS. 3A, 3B and 5, collectively, the valve 120 is generally closed (i.e., the analysis module 118 is isolated from the main flowline 112, as shown in FIG. 3A) while pumping reservoir fluid because cleaning mud and/or other contaminants out of the circulation flow loop may be difficult. The fluid that is pumped into the main flowline 122 may be a mixture of mud filtrate and reservoir fluid caused by the filtrate of drilling mud that invades the formation 104 (FIG. 1) surrounding the borehole 102 (FIG. 1) during and after drilling.

Accordingly, in step 502, the fluid in the main flowline 122 is tested to determine whether it is contaminated with an unacceptable level of filtrate. For example, the multi-channel spectrometer 328 in the IFA module 116 may be used to determine whether there is low contamination reservoir fluid in the main flowline 112. Other qualitative methods such as observing the stabilization of optical density channels and/or comparing a computed gas-oil ratio (GOR) channel versus pumping volume may also be used for this test. If the fluid is contaminated, as determined in a decisional step 504, the method 500 returns to step 502. Alternatively, if the fluid is determined to be uncontaminated or below the acceptable contamination level, the method 500 proceeds to step 506. In step 506, measurements of the fluid are taken using the spectrometer 328 and density-viscosity sensor 330. Such measurements may then be saved for a later quality control procedure.

In step 508, to minimize the risk of damaging the valve 120, the piston 312 of the PVCU 300 is moved forward or backward before opening the valve 120 to minimize the differential pressure between the main flowline 112 and the circulating flowline 122. This may be achieved by monitoring the pressure readings of the P/T sensor 308 in the circulating flowline 122 and the P/T sensor 326 in the main flowline 112 until a minimum differential pressure is reached. In a decisional step 510, a determination is made as to whether opening the valve 120 will result in a first charge of clean fluid. If "yes", the method 500 moves to step 512 wherein, prior to opening the valve 120, measurements of the existing fluid in the circulating flowline may be taken using the optical sensor 306 and the density-viscosity sensor 302 before the first charge of clean fluid. These measurements may then be saved for the later quality control procedure. If the determination in decisional step 510 indicates that it is not the first charge, or after completing step 512, the method 500 moves to step 514.

In step 514, the valve 120 is opened to divert fluid from the main flowline 112 (as illustrated in FIG. 3B). As a result, fluid is charged into the circulating flowline 122 to displace the existing fluid therein in step 516. While charging the fluid in step 516, responses from the optical sensor 306 and density-viscosity sensor 302 are monitored in step 518 until the responses stabilize (e.g., until the responses fall within a particular range, such as less than or equal to one percent or another desired range). A determination may be made in a decisional step 520 as to whether the responses have stabilized. If they have not stabilized, the method 500 returns to step 518. If they have stabilized, the method 500 continues to step 522. In step 522, after charging is completed as determined by step 520, the valve 120 is closed to isolate the circulating flowline 122 from the main flowline 112 (as illustrated in FIG. 3A) and to capture the fluid in the circulating flowline 122.

In step 524, the quality control procedure is performed for the fluid captured in the circulating flowline 122. This procedure is described below in greater detail with respect to FIG. 6. In the present example, the analysis module 118 performs in-situ calibration and measurement operations. These operations may be performed in either a step 526 or a step 530, which differ only in their order relative to a step 528. For example, the in-situ calibration and measurement operations may be performed in step 526 before the execution of step 528, or may be performed in step 530 after the performance of step 528. As such, only one of the steps 526 and 530 will generally be performed. In step 528, a determination is made based on the results of the quality control procedure of step 524 as to whether the captured fluid is clean or an additional charge of reservoir fluid from the main flowline 112 is needed. If an additional charge is needed, the method 500 returns to step 508. It is noted that the saturation pressure for the fluid in the circulating flowline 122 may be an important result obtained from the measurement cycle of step 526. Furthermore, the detected saturation pressure in step 526 can be used in the determination step 528 as to whether the capture fluid is clean or an additional charge of reservoir fluid from the main flowline 112 is needed. For example, the determination criterion can be that the detected saturation pressures from three or more consecutive charges repeat the same value or fall within a specified percentage (e.g., one percent) of each other.

Figure 6:
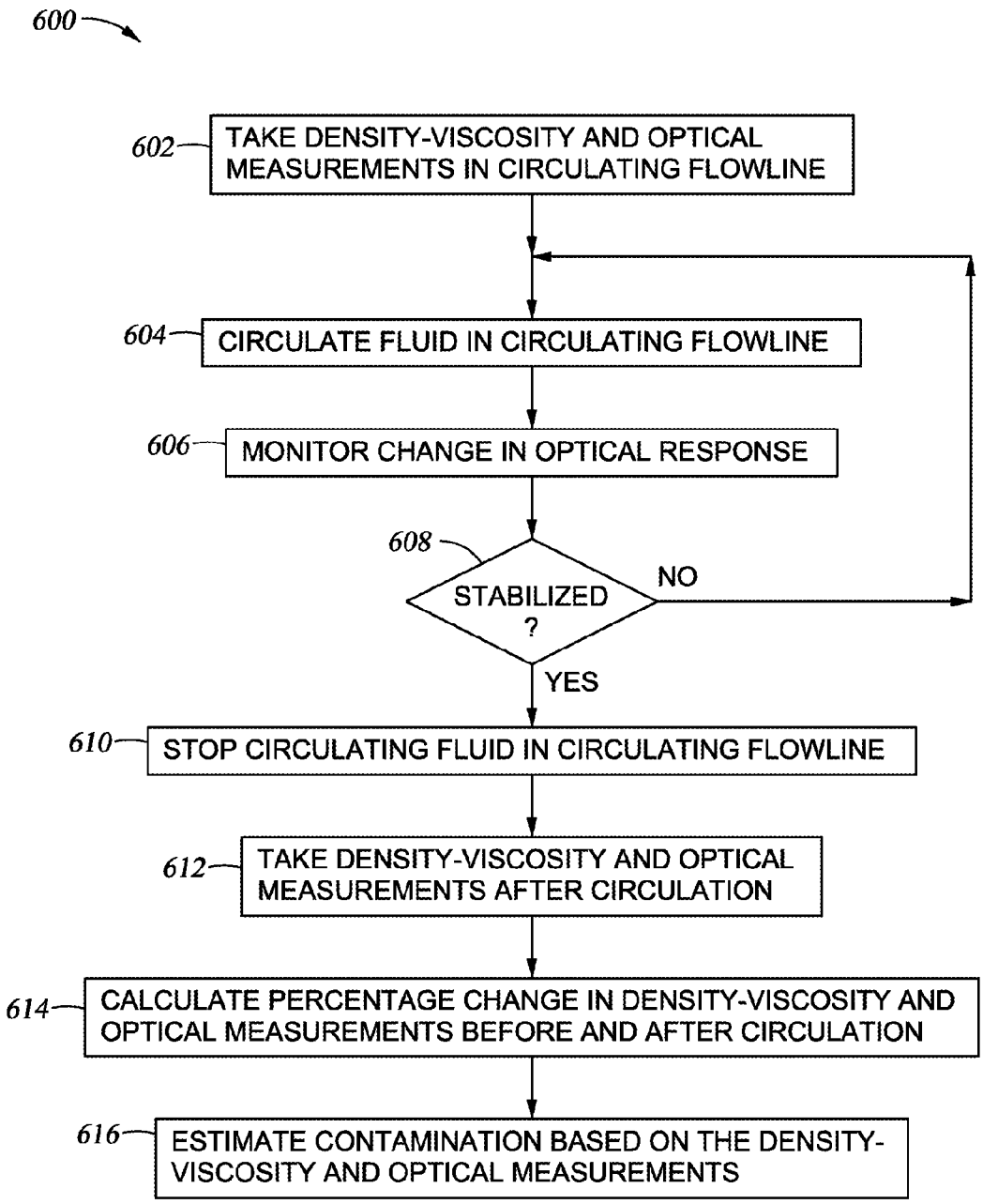
FIG. 6 is a flow chart diagram of at least a portion of a method according to one or more aspects of the present disclosure.

FIG. 6 is a flow-chart diagram of at least a portion of a method 600 according to one or more aspects of the present disclosure. The method 600 may be or comprise a quality control procedure that may be used as the step 524 of FIG. 5 and/or otherwise in combination with one or more other aspects of the present disclosure.

Referring to FIGS. 3A, 3B and 6, collectively, this quality control procedure may be performed on the captured fluid in the circulating flowline 122. One aspect of the quality control procedure is that the fluid in the circulating flowline 122 is circulated using the circulating pump 304. This circulation may dislodge trapped contaminants in the dead spaces along the circulating flowline 122. Therefore, sensor measurements taken before and after the circulation may be used to provide qualitative indications about the cleanness of the captured fluid. More specifically, if the sensor responses before and after the circulation match well (e.g., fall within a defined range), it is an indicator of clean reservoir fluid. Otherwise, the fluid is not clean and the circulating flowline 122 may contain some trapped contaminants.

In step 602, measurements are taken using the optical sensor 306 and density-viscosity sensor 302 before circulation is started. During circulation, measurements obtained by the density-viscosity sensor 302 may be noisy due to the mechanical noise/vibration generated by the circulating pump 304. Accordingly, the measurements of step 602 are taken while the circulating pump 304 is off. Once the measurements are taken in step 602, the circulating pump 304 is activated in step 604 to circulate the fluid in the circulating flowline 122. In step 606, the dynamic response of the optical sensor 306 is monitored because measurements obtained by the optical sensor 306 are not affected by this noise source. The dynamic response reflects the ongoing mixing of fluids in the circulating flowline 122. In a decisional step 608, a determination is made as to whether the response of the optical sensor 306 has stabilized. If the response has not stabilized, the method 600 returns to step 604. If the response has stabilized, the method 600 continues to step 610, where the circulating pump 304 is deactivated.

In step 612, measurements are taken from the optical sensor 306 and the density-viscosity sensor 302. In step 614, a percentage change is calculated for the measurements from the optical sensor 306 and the density-viscosity sensor 302. More specifically, from a quantitative standpoint, the percentage (%) change of the density-viscosity sensor density may be calculated based on its measurements before and after the circulation, i.e.:

$$\%\ \text{change in density} - \text{viscosity sensor density} = 2 \times \frac{\rho_{after} - \rho_{before}}{\rho_{after} + \rho_{before}} \times 100\% \quad \text{(Eq. 1)}$$

where $\rho_{before}$ and $\rho_{after}$ are the density-viscosity sensor density measurements before and after circulation, respectively. Other calculations may include:

$$\%\ \text{change in density} - \text{viscosity sensor viscosity} = 2 \times \frac{\eta_{after} - \eta_{before}}{\eta_{after} + \eta_{before}} \times 100\% \quad \text{(Eq. 2)}$$

$$\%\ \text{change in } sd - \text{response} = 2 \times \frac{SD_{after} - SD_{before}}{SD_{after} + SD_{before}} \times 100\% \quad \text{(Eq. 3)}$$

where $\eta_{before}$ and $\eta_{after}$ are the density-viscosity sensor viscosity measurements before and after the circulation, respectively, and $SD_{before}$ and $SD_{after}$ are the optical sensor responses before and after the circulation, respectively. The sd-response (i.e., the optical sensor response) may be defined as the ratio of the photo-detector (PD) voltages of transmitted signal and reference (or monitor) signal, respectively. The three quantitative measures provided by Equations 1-3 may be used to assess the cleanliness of the fluid in the circulating flowline 122.

In step 616, contamination levels may be estimated based on the measurements of the optical sensor 306 and the density-viscosity sensor 302. More specifically, the relative contamination of existing fluid in the fluid mixture after circulation in the circulating flowline 122 versus the clean reservoir fluid in the main flowline 112 may be estimated by the density-viscosity sensor density measurement:

$$\text{relative contamination in } wt\ \% = \frac{\rho_{after} - \rho_{IFA}}{\rho_{prior} - \rho_{IFA}} \times 100\% \quad \text{(Eq. 4)}$$

where $\rho_{IFA}$ and $\rho_{prior}$ are the density-viscosity sensor 330 density measurement of clean reservoir fluid in the main flowline 112 and the density-viscosity sensor 302 density measurement of existing fluid in the circulating flowline 122 prior to the fluid charging and cleanup, respectively. Because the measurements of the density-viscosity sensors 302 and 330 are involved in the computation, they may be calibrated prior to the logging run.

Similarly, the contamination of existing fluid in the fluid mixture may be calculated based on the optical measurements of the spectrometer 328 and the optical sensor 306. To perform such a calculation, the same wavelength channel may be selected for the spectrometer 328 so that it matches the wavelength used in the optical sensor 306, and the spectrometer 328 and the optical sensor 306 may be calibrated to ensure the two detectors have the same response at the selected wavelength channel. For example, if the optical sensor 306 is a single wavelength detector that uses a wavelength channel of 1600 nm (e.g., baseline channel), the multi-channel spectrometer 328 may be set at a wavelength of 1600 nm. It is noted that, while the optical sensor's optical density measurement is relatively insensitive to the change of fluid under investigation, there are other color channels (e.g., wavelengths of 1000 nm-1500 nm) and hydrocarbon-absorption channels (e.g., wavelengths of 1650 nm-1800 nm) that are sensitive to the change of fluid and may also be suitable.

Having matched the channel wavelengths and calibrated the spectrometer 328 and the optical sensor 306, the relative contamination may be calculated based on optical measurements, i.e.:

$$\text{relative contamination in } vol\ \% = \frac{OD_{after} - OD_{IFA}}{OD_{prior} - OD_{IFA}} \times 100\% \quad \text{(Eq. 5)}$$

where $OD_{IFA}$ and $OD_{prior}$ are the optical density measurement (from the wavelength channel of the spectrometer 328) of clean reservoir fluid in the main flowline 112 and the optical density measurement (from the optical sensor 306) of existing fluid in the circulating flowline 122 prior to the fluid charging and cleanup, respectively, and $OD_{after}$ is the optical density measurement (from the optical sensor 306) after the circulation. The quantitative measures computed from Equations (1)-(5) may then be used to assess and determine whether the captured fluid in the loop flowline is acceptably clean.

In another embodiment, as described with respect to steps 526 and 530 of FIG. 5, the measurement cycle in the fluid cleanup and quality control procedure may be performed prior to step 528 of FIG. 5, rather than after step 528. In such an embodiment, the results obtained from the measurement cycle may be used to judge the cleanness of fluid in the circulating flowline 122.

It is understood that the measurements described herein may be used in many different ways. For example, measurements obtained by the density-viscosity sensor 302 and optical sensor 306 may be plotted with sensor responses as a function of a fluid charging number (e.g., a particular fluid charge). Data at charging number zero may then correspond to sensor responses for the fluid already in place in the circulating flowline 122 before clean reservoir fluid is redirected from the main flowline 112. The plotted data may be used to show the change and trend of fluid properties (as reflected by each sensor response) evolving as a function of a particular fluid charge. For example, the plot may be a density and viscosity plot that reveals that the charging fluid is lighter and less viscous than the original fluid. In another example, a plateau or flattening of the responses may be indicative of clean fluid in the circulating flowline 122 because the fluid properties are seemingly unaltered with additional charges of reservoir fluid.

In some embodiments, the percentage change of sensor responses before and after circulation may be viewed as a function of the fluid charging number. For example, an assumption may be made that the smaller the percentage change of the sensor responses before and after circulation, the cleaner the fluid in the circulating flowline 122. In this case, a threshold for each sensor may be set and, when the computed percentage changes are below the thresholds, the fluid in the circulating flowline 122 may be deemed clean, enabling the subsequent measurement cycle to be conducted.

In yet other embodiments, a relative contamination level (caused by the original fluid in place in the circulating flowline) may be used as a function of the fluid charging number. As described above, two contamination estimates are available: one based on density measurements of the density-viscosity sensors 330 and 302, and the other based on the measurements of the spectrometer 328 and the optical sensor 306. By setting contamination thresholds and determining whether the estimated contamination levels are below the thresholds, a determination may be made as to whether the fluid in the circulating flowline 122 is clean. Furthermore, the estimated contamination levels may be used in combination with the percentage change before and after circulation as described in the preceding paragraph.

In still other embodiments, when the measurement step 526 is performed (e.g., the measurement step is performed prior to the determination step 528 rather than after), a detected saturation pressure may be used a function of the fluid charging number. The detected saturation pressure may be used to judge the cleanliness of fluid in the circulating flowline 122. For example, the fluid charging cycle may be continued until the detected saturation pressures from three or more consecutive charges repeat the same value or stabilize such that their values fall within a specified percentage (e.g., 1%) of each other.

In view of all of the above and the figures, it should be readily apparent to those skilled in the art that the present disclosure introduces a method comprising: directing fluid from a main flowline of the downhole tool to a secondary flowline of the downhole tool; monitoring a plurality of sensor responses corresponding to the fluid in the secondary flowline to determine when the sensor responses stabilize, wherein the monitoring occurs while the fluid is being directed into the secondary flowline; isolating the secondary flowline from the main flowline after the sensor responses have stabilized, wherein the isolating captures fluid in the secondary flowline; performing a quality control procedure on the captured fluid in the secondary flowline to determine whether the captured fluid is the same as the fluid in the main flowline, wherein the quality control procedure uses a plurality of measurements representing at least one property of the captured fluid; and allowing additional fluid from the main flowline into the secondary flowline if the captured fluid is not the same. The method may further comprise: testing fluid in the main flowline for filtrate contamination prior to directing the fluid from the main flowline to the secondary flowline; and repeating the testing if the filtrate contamination in the fluid is above a defined threshold, wherein the testing is repeated until the filtrate contamination is below the defined threshold. The method may further comprise measuring a first fluid property value and a second fluid property value of the fluid in the main flowline using first and second sensors, respectively, wherein the first and second fluid property values are measured after the testing identifies that the filtrate contamination is below the defined threshold. The first fluid property value may be one of fluid density and fluid viscosity and the second fluid property value may be one of optical absorption and optical transmittance. The method may further comprise measuring a third fluid property value and a fourth fluid property value of the fluid in the secondary flowline using third and fourth sensors, respectively, wherein the third and fourth fluid property values are measured prior to the step of directing fluid from the main flowline into the secondary flowline. The third fluid property value may be one of fluid density and fluid viscosity and the fourth fluid property value may be one of optical absorption and optical transmittance. The quality control procedure may include: measuring a fifth fluid property value and a sixth fluid property value of the captured fluid in the secondary flowline using the third and fourth sensors, respectively; agitating the captured fluid after measuring the fifth and sixth fluid property values; monitoring a plurality of sensor responses during the agitating to determine when the sensor responses stabilize; stopping the agitating when the sensor responses have stabilized; measuring a seventh fluid property value and an eighth fluid property value of the captured fluid using the third and fourth sensors, respectively, after stopping the agitating; calculating a first percentage change value of the fifth and seventh fluid property values and a second percentage change value of the sixth and eighth fluid property values; and assessing whether the captured fluid is the same as the fluid in the main flowline based on at least one of the first and second percentage change values. The method may further comprise estimating a relative contamination value in percentage weight based on the first, third, and seventh fluid property values. The method may further comprise estimating a relative contamination value in percentage volume based on the second, fourth, and eighth fluid property values. Monitoring the plurality of sensor responses during the agitating to determine when the sensor responses stabilize may use the fourth sensor. The method may further comprise performing the fluid measurements after allowing additional fluid from the main flowline into the secondary flowline if the captured fluid is not the same. The method may further comprise performing the fluid measurements before allowing additional fluid from the main flowline into the secondary flowline if the captured fluid is not the same.

The present disclosure also introduces a method comprising: directing fluid from a main flowline of a downhole tool to a secondary flowline of the downhole tool; isolating the secondary flowline from the main flowline to capture at least a portion of the fluid in the secondary flowline; measuring a first fluid property value of the captured fluid in the secondary flowline using a first sensor; agitating the captured fluid after measuring the first fluid property value; monitoring a plurality of sensor responses during the agitating to determine when the sensor responses stabilize; stopping the agitating when the sensor responses have stabilized; measuring a second fluid property value of the captured fluid using the first sensor after stopping the agitating; and determining whether the fluid sample is suitably clean for the fluid measurements based on a change relative to a predefined threshold, wherein the change is based on the first and second fluid property values. The method may further comprising: measuring a third fluid property value of the fluid in the main flowline using a second sensor; measuring a fourth fluid property value of the fluid in the secondary flowline using the first sensor, wherein the fourth fluid property value is measured prior to the step of directing fluid from the main flowline into the secondary flowline; and estimating a relative contamination value based on the first, second, and fourth fluid property values. The relative contamination value may be in percentage weight and/or percentage volume. The method may further comprise monitoring a plurality of sensor responses corresponding to the fluid in the secondary flowline to determine when the sensor responses stabilize, wherein the monitoring occurs while the fluid is being directed into the secondary flowline, and wherein the isolating occurs only after the sensor responses have stabilized. The method may further comprise allowing additional fluid from the main flowline into the secondary flowline if the percentage change value does not satisfy the predefined threshold. The method may further comprise: testing fluid in the main flowline for filtrate contamination prior to directing the fluid from the main flowline to the secondary flowline; and repeating the testing if the filtrate contamination in the fluid is above a defined threshold, wherein the testing is repeated until the filtrate contamination is below the defined threshold, wherein the directing fluid from the main flowline to the secondary flowline occurs only when the filtrate contamination is below the defined threshold.

The present disclosure also introduces an apparatus comprising: a main fluid flowline and a circulating fluid flowline each positioned within a housing; an in-situ fluid analyzer comprising a first density sensor and a first optical sensor each coupled to the main fluid flowline; a multi-port valve configured to selectively isolate the main fluid flowline from the circulating fluid flowline; an analysis module comprising a pressure and volume control unit (PVCU) controlled by a motive force producer, a second density sensor, a circulating pump, and a second optical sensor, wherein each of the PVCU, second density sensor, circulating pump, and second optical sensor are coupled to the circulating fluid flowline; and a control module comprising a communications interface coupled to the in-situ fluid analyzer, the multi-port valve, and the analysis module, a processor coupled to the communications interface, and a memory coupled to the processor, wherein the memory comprises instructions executable by the processor to: manipulate the multi-port valve to allow a fluid sample to move from the main fluid flowline to the circulating fluid flowline and then manipulating the valve to isolate the circulating fluid flowline from the main fluid flowline and capture at least a portion of the fluid in the circulating flowline; measure a first fluid property value of the captured fluid in the circulating flowline using one of the second density sensor and the second optical sensor; activate the circulating pump to circulate the captured fluid after measuring the first fluid property value; monitor a plurality of sensor responses of the second optical sensor during the circulating to determine when the sensor responses of the second optical sensor stabilize; deactivate the circulating pump when the sensor responses of the second optical sensor have stabilized, and then measuring a second fluid property value of the captured fluid using the one of the second density sensor and the second optical sensor; and determine whether the fluid sample is suitable for further fluid measurements based on whether a change satisfies a predefined threshold, wherein the change is based on the first and second fluid property values. The memory may further comprise instructions executable by the processor to: measure a third fluid property value of the fluid in the main flowline using one of the first density sensor and the first optical sensor; measure a fourth fluid property value of the fluid in the circulating flowline using the one of the second density sensor and second optical sensor used to measure the first fluid property value, wherein the fourth fluid property value is measured prior to the direction of fluid from the main flowline into the circulating flowline; and estimate a relative contamination based on the second, third, and fourth fluid property values. The memory may further comprise instructions executable by the processor to allow additional fluid from the main flowline into the circulating flowline if the change does not satisfy the predefined threshold.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

directing fluid from a main flowline of the downhole tool to a secondary flowline of the downhole tool;

monitoring a plurality of sensor responses corresponding to the fluid in the secondary flowline to determine when the sensor responses stabilize, wherein the monitoring occurs while the fluid is being directed into the secondary flowline;

isolating the secondary flowline from the main flowline after the sensor responses have stabilized, wherein the isolating captures fluid in the secondary flowline;

performing a quality control procedure on the captured fluid in the secondary flowline to determine whether the captured fluid is the same as the fluid in the main flowline, wherein the quality control procedure uses a plurality of measurements representing at least one property of the captured fluid; and allowing additional fluid from the main flowline into the secondary flowline if the captured fluid is not the same.

2. The method of claim 1 further comprising performing the fluid measurements after allowing additional fluid from the main flowline into the secondary flowline if the captured fluid is not the same.

3. The method of claim 1 further comprising performing the fluid measurements before allowing additional fluid from the main flowline into the secondary flowline if the captured fluid is not the same.

4. The method of claim 1 further comprising:

testing fluid in the main flowline for filtrate contamination prior to directing the fluid from the main flowline to the secondary flowline; and repeating the testing if the filtrate contamination in the fluid is above a defined threshold, wherein the testing is repeated until the filtrate contamination is below the defined threshold.

5. The method of claim 4 further comprising measuring a first fluid property value and a second fluid property value of the fluid in the main flowline using first and second sensors, respectively, wherein the first and second fluid property values are measured after the testing identifies that the filtrate contamination is below the defined threshold.

6. The method of claim 5 wherein the first fluid property value is one of fluid density and fluid viscosity and the second fluid property value is one of optical absorption and optical transmittance.

7. The method of claim 5 further comprising measuring a third fluid property value and a fourth fluid property value of the fluid in the secondary flowline using third and fourth sensors, respectively, wherein the third and fourth fluid property values are measured prior to the step of directing fluid from the main flowline into the secondary flowline.

8. The method of claim 7 wherein the third fluid property value is one of fluid density and fluid viscosity and the fourth fluid property value is one of optical absorption and optical transmittance.

9. The method of claim 7 wherein the quality control procedure includes:

measuring a fifth fluid property value and a sixth fluid property value of the captured fluid in the secondary flowline using the third and fourth sensors, respectively;

agitating the captured fluid after measuring the fifth and sixth fluid property values; monitoring a plurality of sensor responses during the agitating to determine when the sensor responses stabilize;

stopping the agitating when the sensor responses have stabilized;

measuring a seventh fluid property value and an eighth fluid property value of the captured fluid using the third and fourth sensors, respectively, after stopping the agitating;

calculating a first percentage change value of the fifth and seventh fluid property values and a second percentage change value of the sixth and eighth fluid property values; and assessing whether the captured fluid is the same as the fluid in the main flowline based on at least one of the first and second percentage change values.

10. The method of claim 9 further comprising estimating a relative contamination value in percentage weight based on the first, third, and seventh fluid property values.

11. The method of claim 9 further comprising estimating a relative contamination value in percentage volume based on the second, fourth, and eighth fluid property values.

12. The method of claim 9 wherein the monitoring the plurality of sensor responses during the agitating to determine when the sensor responses stabilize uses the fourth sensor.

13. A method, comprising:

directing fluid from a main flowline of a downhole tool to a secondary flowline of the downhole tool;

isolating the secondary flowline from the main flowline to capture at least a portion of the fluid in the secondary flowline;

measuring a first fluid property value of the captured fluid in the secondary flowline using a first sensor;

agitating the captured fluid after measuring the first fluid property value;

monitoring a plurality of sensor responses during the agitating to determine when the sensor responses stabilize;

stopping the agitating when the sensor responses have stabilized;

measuring a second fluid property value of the captured fluid using the first sensor after stopping the agitating; and determining whether the fluid sample is suitably clean for the fluid measurements based on a change relative to a predefined threshold, wherein the change is based on the first and second fluid property values.

14. The method of claim 13 further comprising monitoring a plurality of sensor responses corresponding to the fluid in the secondary flowline to determine when the sensor responses stabilize, wherein the monitoring occurs while the fluid is being directed into the secondary flowline, and wherein the isolating occurs only after the sensor responses have stabilized.

15. The method of claim 13 further comprising allowing additional fluid from the main flowline into the secondary flowline if the percentage change value does not satisfy the predefined threshold.

16. The method of claim 13 further comprising:

testing fluid in the main flowline for filtrate contamination prior to directing the fluid from the main flowline to the secondary flowline; and repeating the testing if the filtrate contamination in the fluid is above a defined threshold, wherein the testing is repeated until the filtrate contamination is below the defined threshold, wherein the directing fluid from the main flowline to the secondary flowline occurs only when the filtrate contamination is below the defined threshold.

17. The method of claim 13 further comprising:

measuring a third fluid property value of the fluid in the main flowline using a second sensor; measuring a fourth fluid property value of the fluid in the secondary flowline using the first sensor, wherein the fourth fluid property value is measured prior to the step of directing fluid from the main flowline into the secondary flowline; and estimating a relative contamination value based on the second, third, and fourth fluid property values.

18. The method of claim 17 wherein the relative contamination value is in percentage weight.

19. The method of claim 17 wherein the relative contamination value is in percentage volume.

20. An apparatus, comprising:

an in-situ fluid analyzer comprising a first density-viscosity sensor and a first optical sensor each coupled to a main fluid flowline;

a multi-port valve configured to selectively isolate the main fluid flowline from a circulating fluid flowline;

a processor and a non-transitory memory coupled to the processor, wherein the memory comprises instructions executable by the processor to:

manipulate the multi-port valve to allow a fluid sample to move from the main fluid flowline to the circulating fluid flowline and then manipulating the valve to isolate the circulating fluid flowline from the main fluid flowline and capture at least a portion of the fluid in the circulating fluid flowline;

measure a first fluid property value of the captured fluid in the circulating fluid flowline using one of the first density-viscosity sensor and the first optical sensor;

activate a circulating pump to circulate the captured fluid after measuring the first fluid property value;

monitor a response of the first optical sensor during the circulating to determine when the sensor response of the first optical sensor stabilizes;

deactivate the circulating pump when the sensor response of the first optical sensor has stabilized, and then measuring a second fluid property value of the captured fluid using one of the first density-viscosity sensor and the first optical sensor; and determine whether the fluid sample is suitable for further fluid measurements based on whether a change satisfies a predefined threshold, wherein the change is based on the first and second fluid property values.

21. The apparatus of claim 20 wherein the memory further comprises instructions executable by the processor to:

measure a third fluid property value of the fluid in the main flowline using one of a second density-viscosity sensor and a second optical sensor;

measure a fourth fluid property value of the fluid in the circulating fluid flowline using the one of the first density-viscosity sensor and the first optical sensor used to measure the first fluid property value, wherein the fourth fluid property value is measured prior to the direction of fluid from the main flowline into the circulating fluid flowline; and estimate a relative contamination based on the second, third, and fourth fluid property values.

22. The apparatus of claim 20 wherein the memory further comprises instructions executable by the processor to allow additional fluid from the main flowline into the circulating fluid flowline if the change does not satisfy the predefined threshold.

* * * * *